US008061896B2

(12) United States Patent
Delgado

(10) Patent No.: US 8,061,896 B2
(45) Date of Patent: Nov. 22, 2011

(54) COMBINATION MEAL BAG AND PLACEMAT

(76) Inventor: Joe Delgado, Los Angeles, CA (US)

( * ) Notice: Subject to any disclaimer, the term of this patent is extended or adjusted under 35 U.S.C. 154(b) by 559 days.

(21) Appl. No.: 12/212,586

(22) Filed: Sep. 17, 2008

(65) Prior Publication Data

US 2010/0065465 A1 Mar. 18, 2010

(51) Int. Cl.
*A45C 11/20* (2006.01)

(52) U.S. Cl. ..... 383/4; 383/120; 206/549

(58) Field of Classification Search ..... 383/127, 383/207; 190/1; 206/549
See application file for complete search history.

(56) References Cited

U.S. PATENT DOCUMENTS

| | | | | |
|---|---|---|---|---|
| 3,594,177 | A | 7/1971 | McGowan | |
| 4,484,350 | A | 11/1984 | Gordon | |
| 4,618,992 | A | 10/1986 | La Grotteria | |
| 5,199,792 | A | 4/1993 | Roosa | |
| 5,279,456 | A | 1/1994 | Bernstein | |
| 5,328,265 | A | 7/1994 | Clooney | |
| 5,507,579 | A | 4/1996 | Sorenson | |
| 5,609,901 | A | 3/1997 | Geddes et al. | |
| 5,964,534 | A | 10/1999 | Welles | |
| 5,988,882 | A | 11/1999 | Fisher et al. | |
| 6,059,179 | A * | 5/2000 | Giampapa | 229/103 |
| 7,043,764 | B2 | 5/2006 | Sky | |
| 7,188,713 | B1 | 3/2007 | Espar et al. | |
| 7,360,256 | B1 | 4/2008 | Jiles et al. | |
| 2004/0136614 | A1 * | 7/2004 | Seidler | 383/4 |
| 2007/0134454 | A1 * | 6/2007 | Broderick | 428/34.2 |
| 2007/0258662 | A1 | 11/2007 | Venditti | |

FOREIGN PATENT DOCUMENTS

| | | | |
|---|---|---|---|
| GB | 2211079 A | * | 6/1989 |
| JP | 2001080649 A | * | 3/2001 |
| JP | 2002114303 A | * | 4/2002 |

* cited by examiner

*Primary Examiner* — Nathan J Newhouse
*Assistant Examiner* — Christopher Demeree
(74) *Attorney, Agent, or Firm* — David A. Belasco; Belasco Jacobs & Townsley, LLP

(57) ABSTRACT

A combination meal bag and placemat has front and rear thermoplastic bag walls each having first and second side edges, a top edge and a bottom edge. The walls are integrally joined to a bottom gusset at the bottom edges and fastened together along the first and second side edges with first and second side seals that fasten first and second outer edges of the bottom gusset to the first and second side edges, respectively. First and second side perforations are spaced from the first and second side edges and extend from the top edge to the bottom edge. When the front wall is pulled away from the rear wall, the first and second side perforations will part, permitting the front and rear walls and bottom gusset to open into a flat placemat. First and second strap handles or die-cut handles are positioned adjacent the top edges of the bag.

6 Claims, 4 Drawing Sheets

COMBINATION MEAL BAG AND PLACEMAT

FIELD OF INVENTION

This invention relates to the field of thermoplastic bags, and more specifically to a bag used for carry-out food that can be easily converted into a multipurpose mat.

BACKGROUND OF THE INVENTION

Diners purchasing meals to go from restaurants, fast food outlets, delicatessens and similar establishments are often planning to eat their food at some location other than their dining room tables. Often they plan to eat in their cars, at a picnic table, at a sporting event or even in front of their televisions. All of these locations lack a clean and convenient place to rest their food while eating it. It would be desirable to have a large and impervious placemat on which to eat the food transported to such a location. Rather than pack along a separate placemat, several attempts have been made to convert a bag used to transport the food into a placemat. Some of these attempts to solve this problem are discussed here.

U.S. Pat. No. 5,998,882, issued to Fisher et al., discloses a bag suitable for carrying sandwich-type foods from a fast food or convenience store. The bag has an open end and an opposite closed end with a front panel and a back panel that are connected together by gusseted side panels. The front panel is provided with lines of perforations forming a weakness the lines being parallel and spaced apart a small distance. Perforations are designed to allow for consistent opening while minimizing premature opening or tearing of the panel. The narrow strip between the perforations is a ripping strip to ease opening of the bag the ripping strip has a pull-tab. Pulling the tab and ripping the ripping strip exposes the bag's interior and the food items therein. The torn bag can be used as a placemat or a receptacle for the food items.

U.S. Patent Application No. 2007/0258662, published for Venditti is directed to a container that can be readily transformed into a mat providing a safe resting surface for the contents of the container. The container preferably made out of paper, cardboard, plastic, foil, metal, or wood is in the form of a bag or box. The container can be used for food or automotive products, hardware products, medical products, toys, and the like. The container has a flat bottom, opposing spaced apart first and second sides and opposing spaced apart first and second faces. A first line of perforations vertically extend from the open end of the container to a second line of perforations that are horizontally disposed about the perimeter of the container near the bottom. For use of the container the perforations are opened leaving the items in the container in the resulting bottom tray. The sides of the container can be used as a mat providing a clean surface for the contents of the container.

U.S. Pat. No. 4,618,992, issued to La Grotteria illustrates two embodiments of a bag that is convertible to a placemat. The first embodiment is a bag with a flat bottom having a vertical line of perforations on one sidewall and a line of perforations at the bottom of three of the sidewalls. When it is desired to have a placemat the bag can be set down with the contents inside and the perforations separated forming a placemat. The second type of bag has a folded end rather than a flat bottom. The bag has a vertical line of perforations on one sidewall and a line of perforations near the bottom. When both lines of perforations are separated the bag can be laid flat forming a placemat.

U.S. Pat. No. 5,609,901, issued to Geddes et al. disclose a perforated package of composite material for packaging and maintaining foodstuffs in a hot and palatable condition. The invention is a perforated package made from a composite integral sheet material formed into a bag which has at least one area of perforation allowing a portion of the bag to be drawn back providing easy access to the article contained therein. Preferably the perforated area comprises two parallel lines preferably located along or closely adjacent to the edges of the package. In use the food product preferably hot is put into the bag, the opened end is sealed and the bag with the foodstuff in it is given to a customer. The bag may be used in a variety of ways by the customer. If the customer pulls the side panel down along the perforations he provides a surface upon which the food article rests. The bag provides a sanitary surface which has not been previously handled.

U.S. Pat. No. 4,484,350, issued to Gordon is directed to a glueless paper bag that is formed from a single sheet of paper or similar flexible sheet material. The blank is formed or otherwise provided with eight relatively spaced apart parallel fold lines that extend longitudinally the full length of the blank. The blank is folded along the lines to form a rectangular open ended tube. The tube is folded transversely along a pair of relatively spaced transverse fold lines forming generally rectangular and relatively adjoining sections, a forward open-mouthed bag section, a multiple ply backing section and a multiple ply tuck and locking section. By folding the backing section upwardly against the rear or inner wall of the bag section and then tucking the locking section downwardly into the open mouth of the bag section and into overlying relation to the backing section provides a condition with the smooth and interrupted outer panel of the blank is outermost and relatively interlocking, interleaved, free edges of the blank are fully covered and held against accidental separation. The device may be used as a carryout bag for food items and upon arrival at a convenient eating spot may be easily unfolded into its flat length condition and used as a doily, napkin or bib.

It is an objective of the present invention to provide a convenient and spacious carry bag formed of impervious material for the transport of food items. It is a further objective to provide such a bag that can be readily converted to a sanitary placemat suitable for dining upon. It is a still further objective of the invention that the resulting placemat be completely flat and suitable for folding and storage for later use. Finally, it is an objective of the present invention to provide such bag that is inexpensive to manufacture and easy to carry when loaded and yet stores flat when empty.

While some of the objectives of the present invention are disclosed in the prior art, none of the inventions found include all of the requirements identified.

SUMMARY OF THE INVENTION

The present invention addresses all of the deficiencies of prior art combination meal bag and placemat inventions and satisfies all of the objectives described above.

(1) A combination meal bag and placemat can be fabricated from the following components. Front and rear thermoplastic walls are provided. Each of the front and rear walls have first and second side edges, a top edge and a bottom edge. The walls are integrally joined to a bottom gusset at the bottom edges and fastened together along the first and second side edges with first and second side seals. The first and second side seals fasten first and second outer edges of the bottom gusset to the first and second side edges, respectively. The top edges define an open bag mouth. A first side perforation is provided. The first perforation is spaced from the first side edge and extends from the top edge to the bottom edge. A second side perforation is provided. The second perforation is spaced from the second side edge and extends from the top edge to the bottom edge. When the front wall is pulled away from the rear wall, the first and second side perforations will part, permitting the front and rear walls and bottom gusset to open into a flat placemat.

(2) In a variant of the invention, first and second strap handles are provided. Each of the handles is formed as a flat portion of thermoplastic and has a first end and a second end. Each of the first and second ends is sealed to an inner surface or an outer surface of one the front and rear walls adjacent the top edges, thereby forming a pair of strap handles at the bag mouth.

(3) In another variant, first and second die-cut handles are provided. The die-cut handles are formed as openings penetrating the front and rear walls. The openings are spaced downwardly from the top edges.

(4) In still another variant, a combination meal bag and placemat, includes front and rear thermoplastic walls. Each of the front and rear walls have first and second side edges, a top edge and a bottom edge. The walls are integrally joined at the bottom edges and fastened together along the first and second side edges with first and second side seals. The top edges define an open bag mouth. A first side perforation is provided. The first perforation is spaced from the first side edge and extends from the top edge to the bottom edge. A second side perforation is provided. The second perforation is spaced from the second side edge and extends from the top edge to the bottom edge. When the front wall is pulled away from the rear wall, the first and second side perforations will part, permitting the front and rear walls to open into a flat placemat.

(5) In yet another variant, first and second strap handles are provided. Each of the handles is formed as a flat portion of thermoplastic and has a first end and a second end. Each of the first and second ends is sealed to an inner surface or an outer surface of one the front and rear walls adjacent the top edges, thereby forming a pair of strap handles at the bag mouth.

(6) In a final variant, first and second die-cut handles are provided. The die-cut handles are formed as openings penetrating the front and rear walls. The openings are spaced downwardly from the top edges.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-5 illustrate a combination meal bag and placemat 10 that can be fabricated from the following components. Front 14 and rear 18 thermoplastic walls are provided. Each of the front 14 and rear 18 walls have first 22 and second 26 side edges, a top edge 30 and a bottom edge 34. The walls 14, 18 are integrally joined to a bottom gusset 38 at the bottom edges 34 and fastened together along the first 22 and second 26 side edges with first 42 and second 46 side seals. The first 42 and second 46 side seals fasten first 50 and second 54 outer edges of the bottom gusset 38 to the first 22 and second 26 side edges, respectively. The top edges 30 define an open bag mouth 58. A first side perforation 62 is provided. The first perforation 62 is spaced from the first side edge 22 and extends from the top edge 30 to the bottom edge 34. A second side perforation 66 is provided. The second perforation 66 is spaced from the second side edge 26 and extends from the top edge 30 to the bottom edge 34. When the front wall 14 is pulled away from the rear wall 18, the first 62 and second side perforations 66 will part, permitting the front 14 and rear 18 walls and bottom gusset 38 to open into a flat placemat 70.

Figure 1:
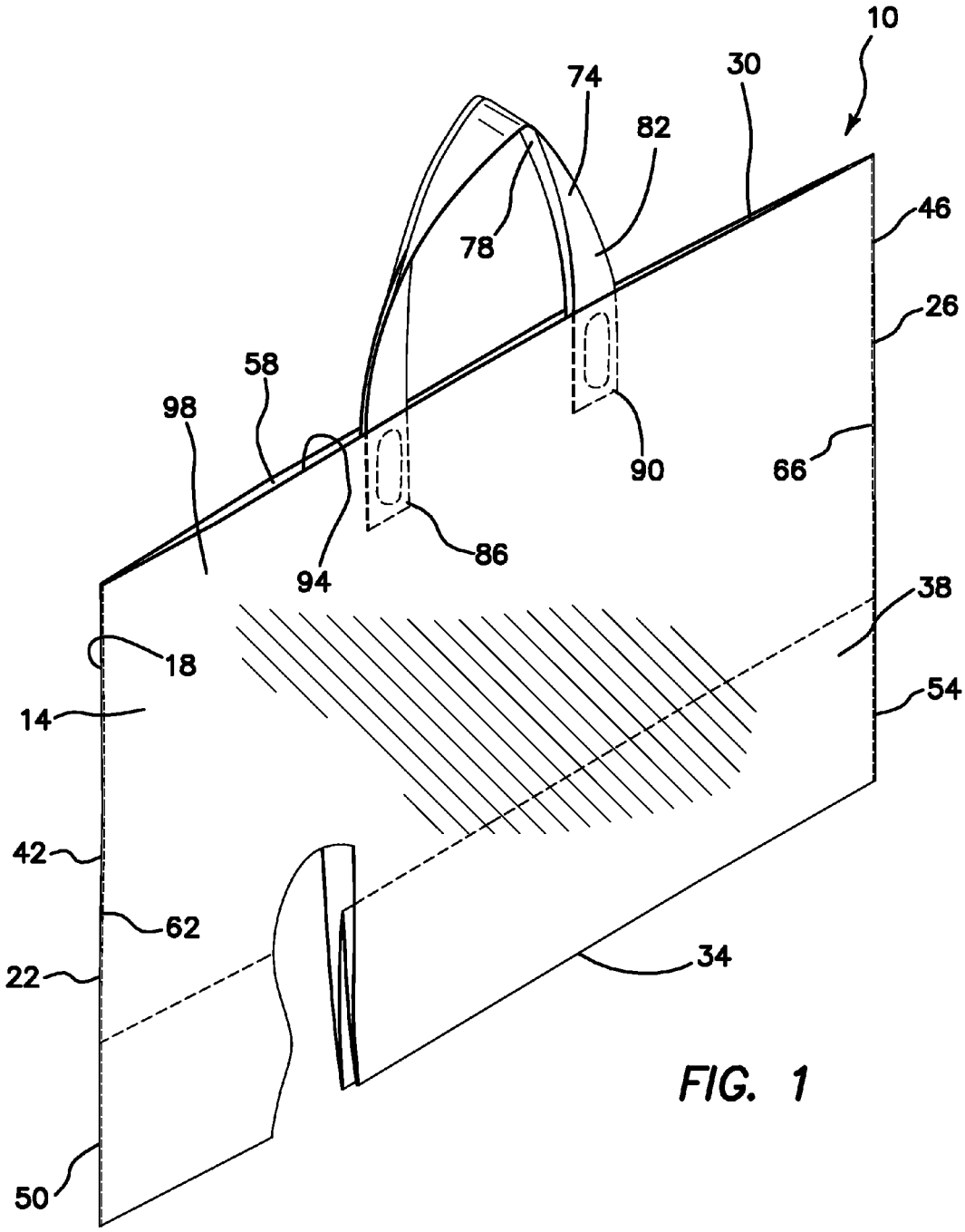
FIG. 1 is a perspective view of the preferred embodiment of the invention including a partial section through the bottom gusset of the bag.
Figure 2:
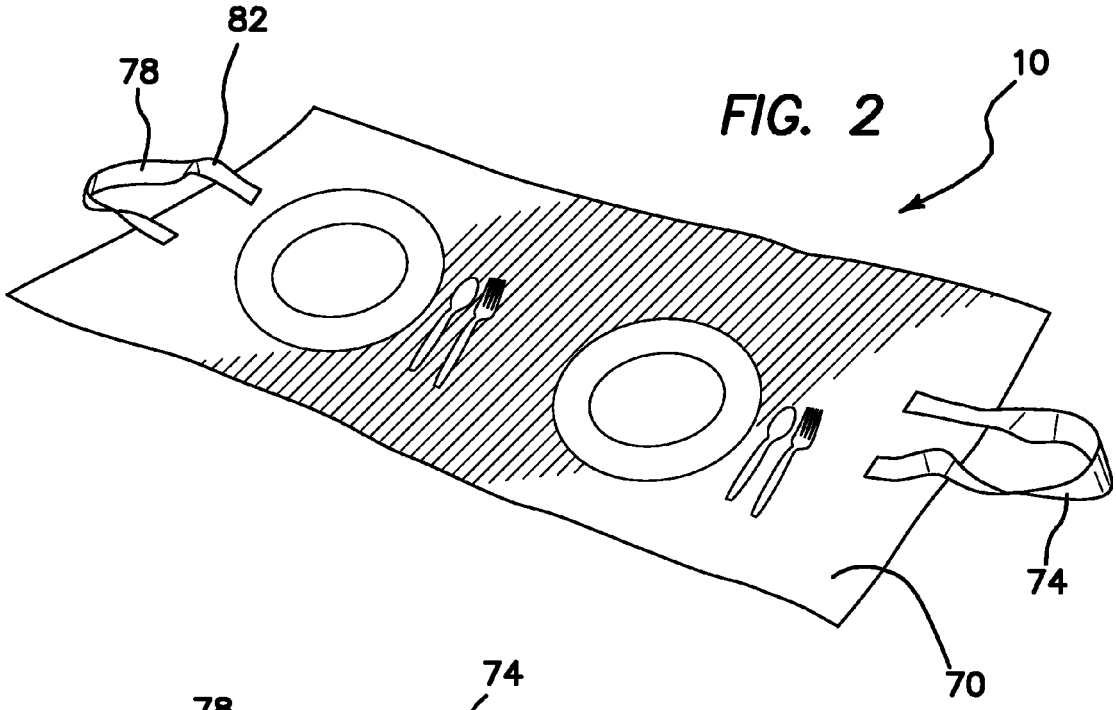
FIG. 2 is a perspective view of the FIG. 1 embodiment opened into a placemat.
Figure 3:
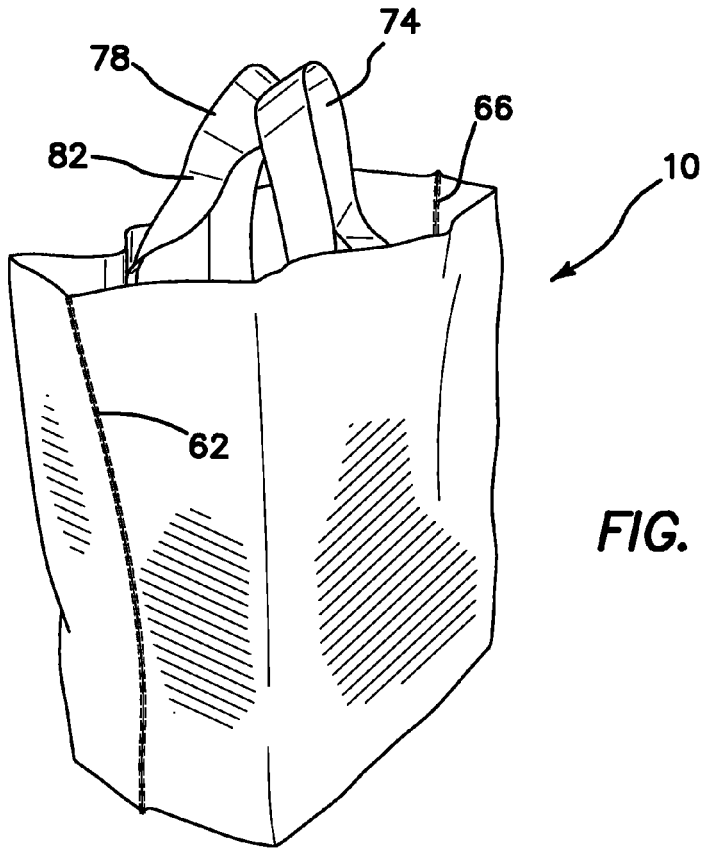
FIG. 3 is a perspective view of the FIG. 1 embodiment illustrating the bag in an opened condition.

(2) In a variant of the invention, first 74 and second 78 strap handles are provided. Each of the handles 74, 78 is formed as a flat portion of thermoplastic 82 and has a first end 86 and a second end 90. Each of the first 86 and second 90 ends is sealed to an inner surface 94 or an outer surface 98 of one the front 14 and rear 18 walls adjacent the top edges 30, thereby forming a pair of strap handles 74, 78 at the bag mouth 58.

Figure 4:
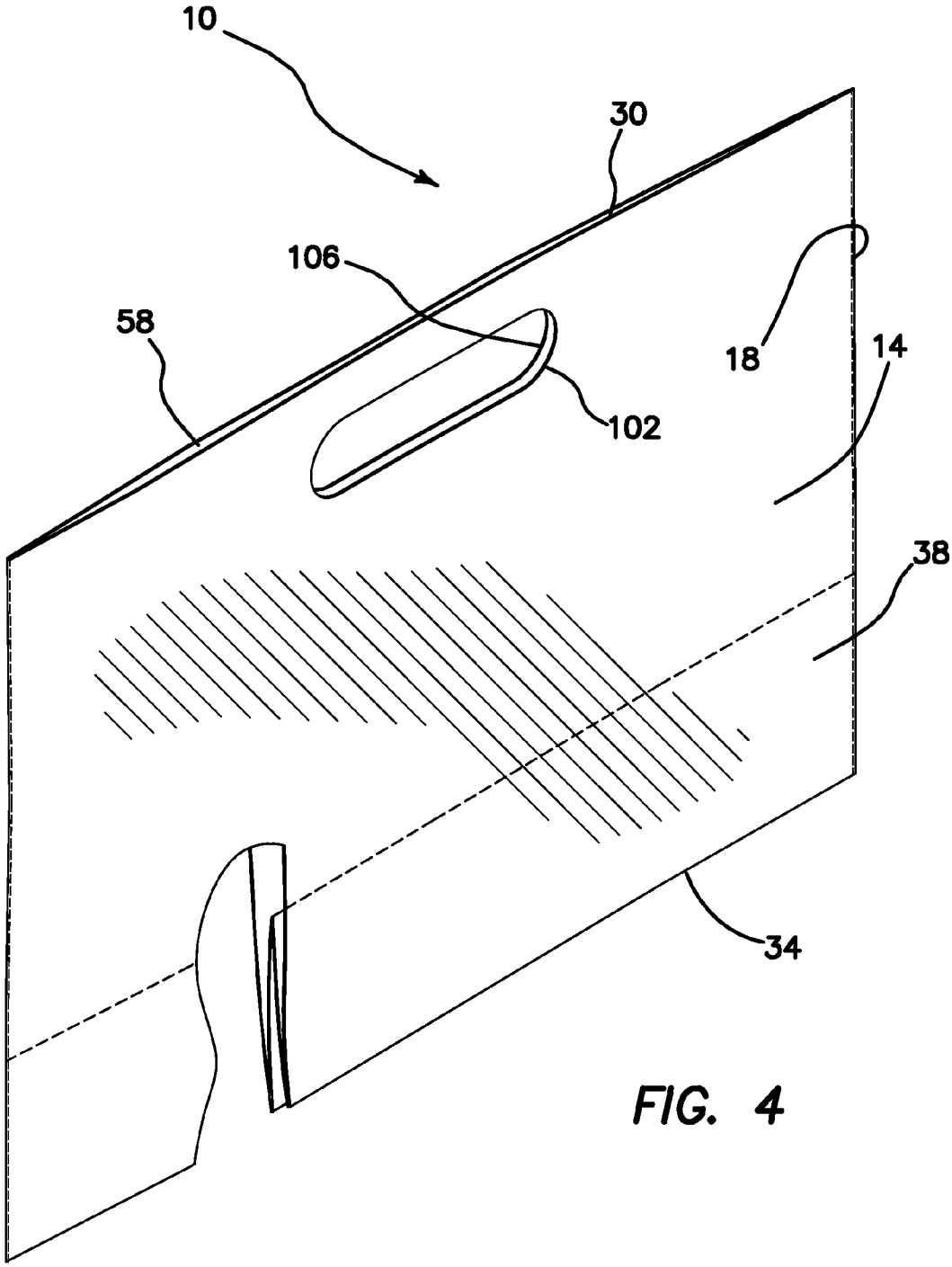
FIG. 4 is a perspective view of a second embodiment of the invention, illustrating a die-cut handle.

(3) In another variant, as illustrated in FIG. 4, first 102 and second 106 die-cut handles are provided. The die-cut handles 102, 106 are formed as openings penetrating the front 14 and rear 18 walls. The openings 102, 106 are spaced downwardly from the top edges 30.

Figure 5:
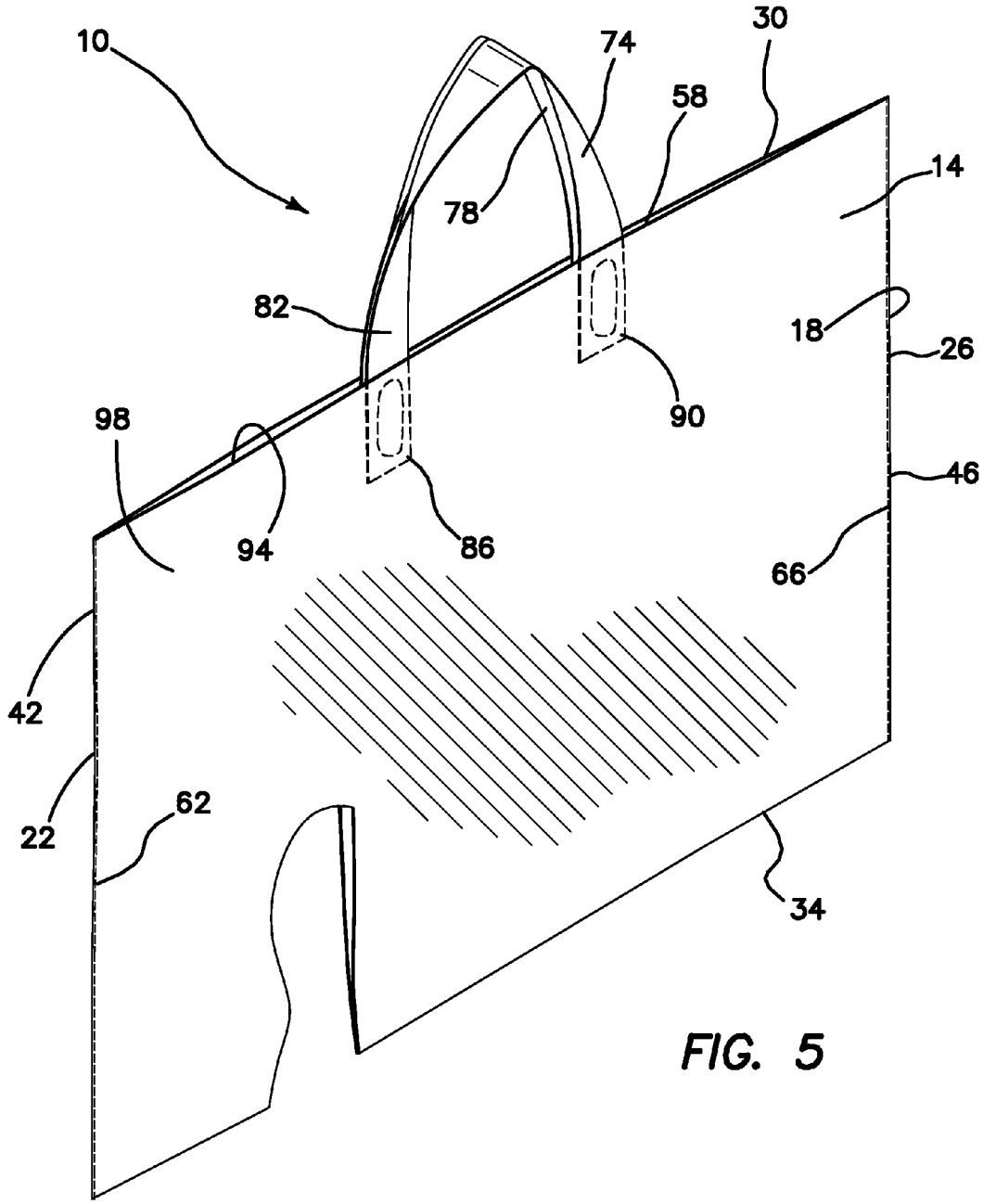
FIG. 5 is a perspective view of a third embodiment of the invention, illustrating a non-gusseted bag bottom.

(4) In still another variant, as illustrated in FIG. 5, a combination meal bag and placemat 10, includes front 14 and rear 18 thermoplastic walls. Each of the front 14 and rear 18 walls have first 22 and second 26 side edges, a top edge 30 and a bottom edge 34. The walls 14, 18 are integrally joined at the bottom edges 34 and fastened together along the first 22 and second 26 side edges with first 42 and second 46 side seals. The top edges 30 define an open bag mouth 58. A first side perforation 62 is provided. The first perforation 62 is spaced from the first side edge 22 and extends from the top edge 30 to the bottom edge 34. A second side perforation 66 is provided. The second perforation 66 is spaced from the second side edge 26 and extends from the top edge 30 to the bottom edge 34. When the front wall 14 is pulled away from the rear wall 18, the first 62 and second 66 side perforations will part, permitting the front 14 and rear 18 walls to open into a flat placemat 70.

(5) In yet another variant, first 74 and second 78 strap handles are provided. Each of the handles 74, 78 is formed as a flat portion of thermoplastic 82 and has a first end 86 and a second end 90. Each of the first 86 and second 90 ends is sealed to an inner surface 94 or an outer surface 98 of one the front 14 and rear 18 walls adjacent the top edges 30, thereby forming a pair of strap handles 74, 78 at the bag mouth 58.

(6) In a final variant, as illustrated in FIG. 4, first 102 and second 106 die-cut handles are provided. The die-cut handles 102, 106 are formed as openings penetrating the front 14 and rear 18 walls. The openings 102, 106 are spaced downwardly from the top edges 30.

The combination meal bag and placemat 10 has been described with reference to particular embodiments. Other modifications and enhancements can be made without departing from the spirit and scope of the claims that follow.

The invention claimed is:

1. A combination meal bag and placemat, comprising:

front and rear thermoplastic walls, each of said front and rear walls having first and second side edges, a top edge and a bottom edge;

said walls being integrally joined to a bottom gusset at said bottom edges and fastened directly together along said first and second side edges with first and second side seals;

said first and second side seals fastening first and second outer edges of said bottom gusset directly to said first and second side edges, respectively;

said top edges defining an open bag mouth;

a first side perforation, said first perforation being spaced from said first side edge and extending from said top edge to said bottom edge;

a second side perforation, said second perforation being spaced from said second side edge and extending from said top edge to said bottom edge; and wherein pulling said front wall away from said rear wall causes parting of said first and second side perforations, permitting said front and rear walls and bottom gusset to open into a flat placemat;

said placemat being defined by said first and second side edges and said top edges of said front and rear walls; and an entire extent of said placemat being flat.

2. The combination meal bag and placemat, as described in claim 1, further comprising:

first and second strap handles, each of said handles formed as a flat portion of thermoplastic having a first end and a second end;

each of said first and second ends being sealed to either of an inner surface and an outer surface of one said front and rear walls adjacent said top edges, thereby forming a pair of strap handles at said bag mouth.

3. The combination meal bag and placemat, as described in claim 1, further comprising first and second die-cut handles, said die-cut handles formed as openings penetrating said front and rear walls spaced downwardly from said top edges.

4. A combination meal bag and placemat, comprising:

front and rear thermoplastic walls, each of said front and rear walls having first and second side edges, a top edge and a bottom edge;

said walls being integrally joined directly at said bottom edges and fastened directly together along said first and second side edges with first and second side seals;

said top edges defining an open bag mouth;

a first side perforation, said first perforation being spaced from said first side edge and extending from said top edge to said bottom edge;

a second side perforation, said second perforation being spaced from said second side edge and extending from said top edge to said bottom edge; and wherein pulling said front wall away from said rear wall causes parting of said first and second side perforations, permitting said front and rear walls to open into a flat placemat;

said placemat being defined by said first and second side edges and said top edges of said front and rear walls; and an entire extent of said placemat being flat.

5. The combination meal bag and placemat, as described in claim 4, further comprising:

first and second strap handles, each of said handles formed as a flat portion of thermoplastic having a first end and a second end;

each of said first and second ends being sealed to either of an inner surface and an outer surface of one said front and rear walls adjacent said top edges, thereby forming a pair of strap handles at said bag mouth.

6. The combination meal bag and placemat, as described in claim 4, further comprising first and second die-cut handles, said die-cut handles formed as openings penetrating said front and rear walls spaced downwardly from said top edges.

* * * * *